US010364975B2

(12) United States Patent
Rizkin et al.

(10) Patent No.: US 10,364,975 B2
(45) **Date of Patent: *Jul. 30, 2019**

(54) HIGHLY EFFICIENT LED ARRAY MODULE WITH PRE-CALCULATED NON-CIRCULAR ASYMMETRICAL LIGHT DISTRIBUTION

(71) Applicants: BRIDGELUX, INC., Livermore, CA (US); Anna Volkoff, Sherman Oaks, CA (US)

(72) Inventors: Alexander Rizkin, Livermore, CA (US); Robert Tudhope, Livermore, CA (US); Vahid Moshtagh, Livermore, CA (US); Hannu Tapani Hukkanen, Livermore, CA (US); Tomi Mikael Kuntze, Livermore, CA (US)

(73) Assignee: BRIDGELUX INC., Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/531,828

(22) Filed: Nov. 3, 2014

(65) Prior Publication Data

US 2015/0062898 A1 Mar. 5, 2015

Related U.S. Application Data

(63) Continuation of application No. 13/869,887, filed on Apr. 24, 2013, now Pat. No. 8,915,622, which is a (Continued)

(51) Int. Cl.
*F21K 99/00* (2016.01)
*F21V 29/70* (2015.01)
(Continued)

(52) U.S. Cl.
CPC ..... *F21V 29/70* (2015.01); *F21K 9/60* (2016.08); *F21V 7/00* (2013.01); *F21V 7/0025* (2013.01);
(Continued)

(58) Field of Classification Search
CPC ..... F21K 9/50; F21B 7/0083; F21V 29/22; F21V 7/22; F21Y 2101/02
(Continued)

(56) References Cited

U.S. PATENT DOCUMENTS 3,112,075 A * 11/1963 Sparks ..... G03B 27/545 362/241
4,794,501 A 12/1988 Bartenbach
(Continued)

*Primary Examiner* — Jong-Suk (James) Lee
*Assistant Examiner* — Christopher E Dunay
(74) *Attorney, Agent, or Firm* — Arent Fox LLP

(57) ABSTRACT

A light module includes a light emitting diode (LED) array and a double-reflective assembly coupled to the LED array. The double-reflective assembly includes a lower member having a frame. The frame has an opening corresponding to the LED array. The frame and LED array are located in the same plane. The light module further includes a left bottom reflector and a right bottom reflector. The light module further includes an upper member which includes a left top reflector; and a right top reflector, wherein the left top reflector is attached to the left bottom reflector, and right top reflector is attached to the right bottom reflector, each forming an arbitrary left and right double-reflective assembly. A shape geometry and profile of each double-reflective assembly provides a pre-calculated combined non-circular asymmetrical intensity distribution pattern. The intensity distribution pattern is a superposition of light reflected from the bottom reflectors, light reflected from the top reflectors, light doubly reflected from both the top and bottom reflectors, and light directed into the intensity distribution pattern directly from the LED array.

18 Claims, 12 Drawing Sheets

Related U.S. Application Data continuation of application No. 13/083,417, filed on Apr. 8, 2011, now Pat. No. 8,496,362.

(60) Provisional application No. 61/322,756, filed on Apr. 9, 2010.

(51) Int. Cl.

| | |
|---|---|
| ***F21V 7/09*** | (2006.01) |
| ***F21V 7/00*** | (2006.01) |
| ***F21V 7/22*** | (2018.01) |
| ***F21K 9/60*** | (2016.01) |
| *F21W 131/103* | (2006.01) |
| *F21Y 105/10* | (2016.01) |
| *F21Y 115/10* | (2016.01) |

(52) U.S. Cl.
CPC ..... *F21V 7/0083* (2013.01); *F21V 7/09* (2013.01); *F21V 7/22* (2013.01); *F21W 2131/103* (2013.01); *F21Y 2105/10* (2016.08); *F21Y 2115/10* (2016.08)

(58) Field of Classification Search
USPC ..... 362/257, 241, 243, 317, 341, 346, 356
See application file for complete search history.

(56) References Cited

U.S. PATENT DOCUMENTS 5,685,634 A 11/1997 Mulligan
6,471,383 B1 * 10/2002 Oyama ..... F21S 48/1388 362/298
6,527,411 B1 * 3/2003 Sayers ..... F21S 48/1154 362/237
6,554,455 B2 * 4/2003 Perlo ..... B60Q 1/302 362/297
6,814,475 B2 11/2004 Amano
6,851,835 B2 2/2005 Smith et al.
6,976,775 B2 12/2005 Koike
7,079,041 B2 7/2006 Fredericks et al.
7,237,927 B2 7/2007 Coushaine et al.
7,306,352 B2 12/2007 Sokolov et al.
7,824,067 B2 11/2010 Martineau et al.
8,070,328 B1 12/2011 Knoble et al.
8,123,377 B2 2/2012 Lundberg et al.
8,177,391 B2 5/2012 Ryu et al.
8,210,706 B2 7/2012 Rooymans et al.
8,220,962 B2 * 7/2012 Cheng ..... F21V 7/0083 362/227
8,240,879 B2 8/2012 Hsu et al.
8,469,362 B1 6/2013 Rosenberg
8,496,362 B2 * 7/2013 Rizkin et al. ..... 362/346
8,608,339 B2 * 12/2013 Gerli ..... F21S 4/008 362/235
2002/0048176 A1 * 4/2002 Ruda ..... F21V 7/005 362/551
2006/0023461 A1 * 2/2006 Knight ..... B60Q 1/076 362/466
2008/0232102 A1 9/2008 Martineau
2009/0147523 A1 * 6/2009 Levon ..... B44C 5/005 362/296.01
2010/0128476 A1 5/2010 Hsu et al.
2010/0134046 A1 * 6/2010 Holder ..... F21V 19/001 315/297
2010/0165633 A1 7/2010 Moolman et al.

* cited by examiner

HIGHLY EFFICIENT LED ARRAY MODULE WITH PRE-CALCULATED NON-CIRCULAR ASYMMETRICAL LIGHT DISTRIBUTION

CROSS-REFERENCE TO RELATED APPLICATIONS

This application is a continuation of and claims priority to U.S. Nonprovisional patent application Ser. No. 13/869,887, titled "HIGHLY EFFICIENT LED ARRAY MODULE WITH PRE-CALCULATED NON-CIRCULAR ASSYMETRICAL LIGHT DISTRIBUTION," filed Apr. 24, 2013, which is a continuation of and claims priority to U.S. Nonprovisional patent application Ser. No. 13/083,417, titled "HIGHLY EFFICIENT LED ARRAY MODULE WITH PRE-CALCULATED NON-CIRCULAR ASSYMETRICAL LIGHT DISTRIBUTION," filed Apr. 8, 2011, which is a non-provisional of and claims priority to U.S. Provisional Patent Application No. 61/322,756, titled "HIGHLY EFFICIENT LED ARRAY MODULE WITH PRE-CALCULATED NON-CIRCULAR ASSYMETRICAL LIGHT DISTRIBUTION," filed Apr. 9, 2010, each of which are hereby incorporated by reference in their entireties.

BACKGROUND

Field

The present disclosure relates to a light module and, more particularly, to a light emitting diode (LED) array optical module based on a double-reflective element concept.

Description of Related Art

Light modules have been developed for various applications, but most of them have been addressed to a single source reflective module, which creates a roughly circular pattern but provide an uneven light distribution pattern.

SUMMARY

In an aspect of the disclosure set forth herein, a light module includes a LED array, a double-reflective assembly coupled to the LED array, where the double-reflective assembly includes a lower member having a frame, wherein the frame has an opening corresponding to the LED array. The frame and LED array are located in the same plane. The light module further includes a left bottom reflector and a right bottom reflector. The light module further includes an upper member which includes a left top reflector; and a right top reflector, wherein the left top reflector is attached to the left bottom reflector, and right top reflector is attached to the right bottom reflector, each forming an arbitrary left and right double-reflective assembly, wherein a shape geometry and profile of each double-reflective assembly providing a pre-calculated combined non-circular asymmetrical intensity distribution pattern, wherein the intensity distribution pattern is a superposition of light reflected from the bottom reflectors, light reflected from the top reflectors, light doubly reflected from both the top and bottom reflectors, and light directed into the intensity distribution pattern directly from the LED array.

In yet another aspect of the disclosure set forth herein, a method of forming a pre-determined non-circular asymmetrical light distribution pattern in a plane of illumination, includes emitting light from a LED array, and reflecting a portion of the emitted light from a double-reflective array assembly, wherein the double-reflective assembly includes a lower member comprising a frame, the frame having an opening corresponding to the LED array, wherein the frame and LED array are located in the same plane, wherein the lower member further includes a left bottom reflector and a right bottom reflector; wherein the double-reflective assembly further includes an upper member comprising a left top reflector and a right top reflector, wherein the left top reflector is attached to the left bottom reflector, and right top reflector is attached to the right bottom reflector, each forming an arbitrary left and right double-reflective assembly, wherein a shape geometry and profile of each double-reflective assembly providing a pre-calculated combined non-circular asymmetrical intensity distribution pattern, wherein the intensity distribution pattern is a superposition of light reflected from the bottom reflectors, light reflected from the top reflectors, light doubly reflected from both the top and bottom reflectors, and light directed into the intensity distribution pattern directly from the LED array.

BRIEF DESCRIPTION OF THE DRAWINGS

The present disclosure relates to a light emitting module that utilizes an array of light emitting devices including, for example, light emitting diodes (LEDs) as a light source and can create non-circular asymmetrical patterns with pre-calculated intensity distribution.

DETAILED DESCRIPTION

Figure 1A:
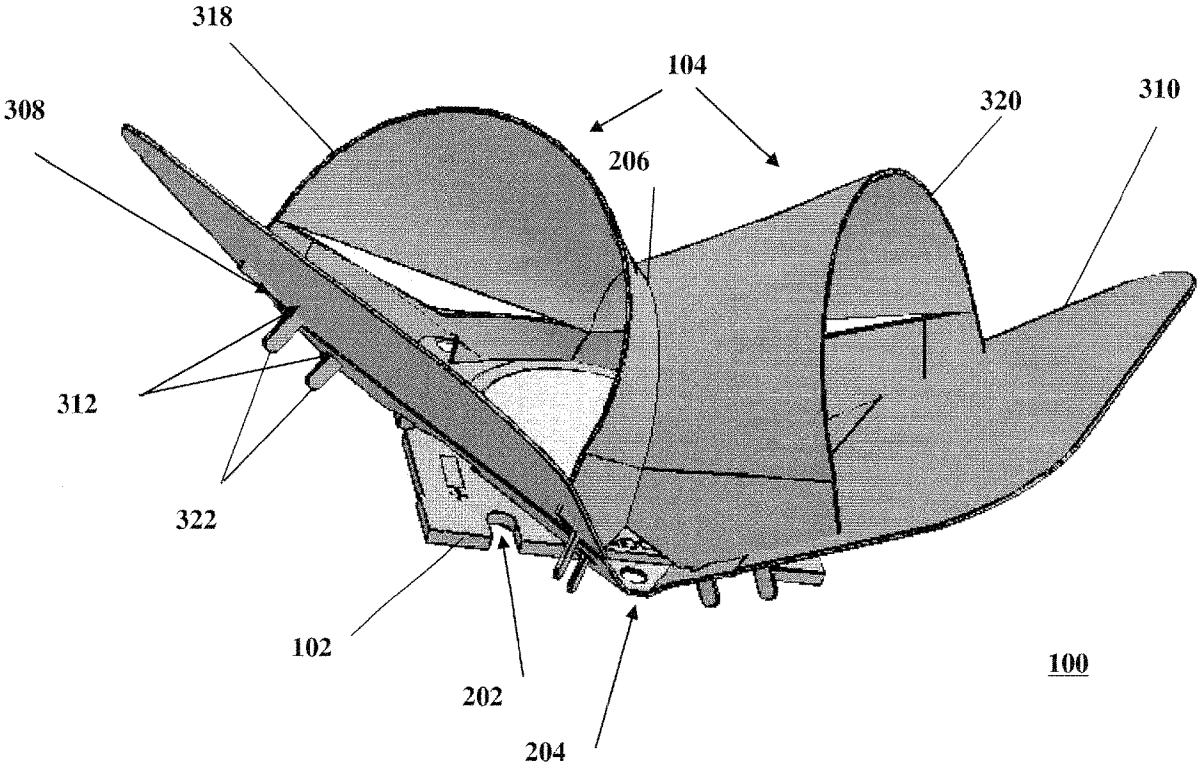
FIGS. 1A-1B are perspective views of an exemplary light emitting module configured in accordance with one aspect of the light emitting device module disclosed herein. The light emitting module includes a double-reflective assembly shaped and arranged to produce the pre-calculated illumination pattern.

The present invention is described more fully hereinafter with reference to the accompanying drawings, in which various aspects of the present invention are shown. This invention, however, may be embodied in many different forms and should not be construed as limited to the various aspects of the present invention presented throughout this disclosure. Rather, these aspects are provided so that this disclosure will be thorough and complete, and will fully convey the scope of the present invention to those skilled in the art. The various aspects of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. By way of example, an element illustrated or described as a rectangle may have rounded or curved features and/or a gradient concentration at its edges rather than a discrete change from one element to another. Thus, the elements illustrated in the drawings are schematic in nature and their shapes are not intended to illustrate the precise shape of an element and are not intended to limit the scope of the present invention.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element is referred to as being "formed" on another element, it can be grown, deposited, etched, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the drawings. By way of example, if an apparatus in the drawings is turned over, elements described as being on the "lower" side of other elements would then be oriented on the "upper" side of the other elements. The term "lower", can therefore, encompass both an orientation of "lower" and "upper," depending of the particular orientation of the apparatus. Similarly, if an apparatus in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this disclosure.

As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

Whereas the embodiments presented below are described in terms of an array of LEDs for a light source, any other light sources that may be approximately represented as point light sources may be contemplated as well within the scope and intent of the disclosure, including lasers, miniature bulbs, and the like.

Figure 1B:
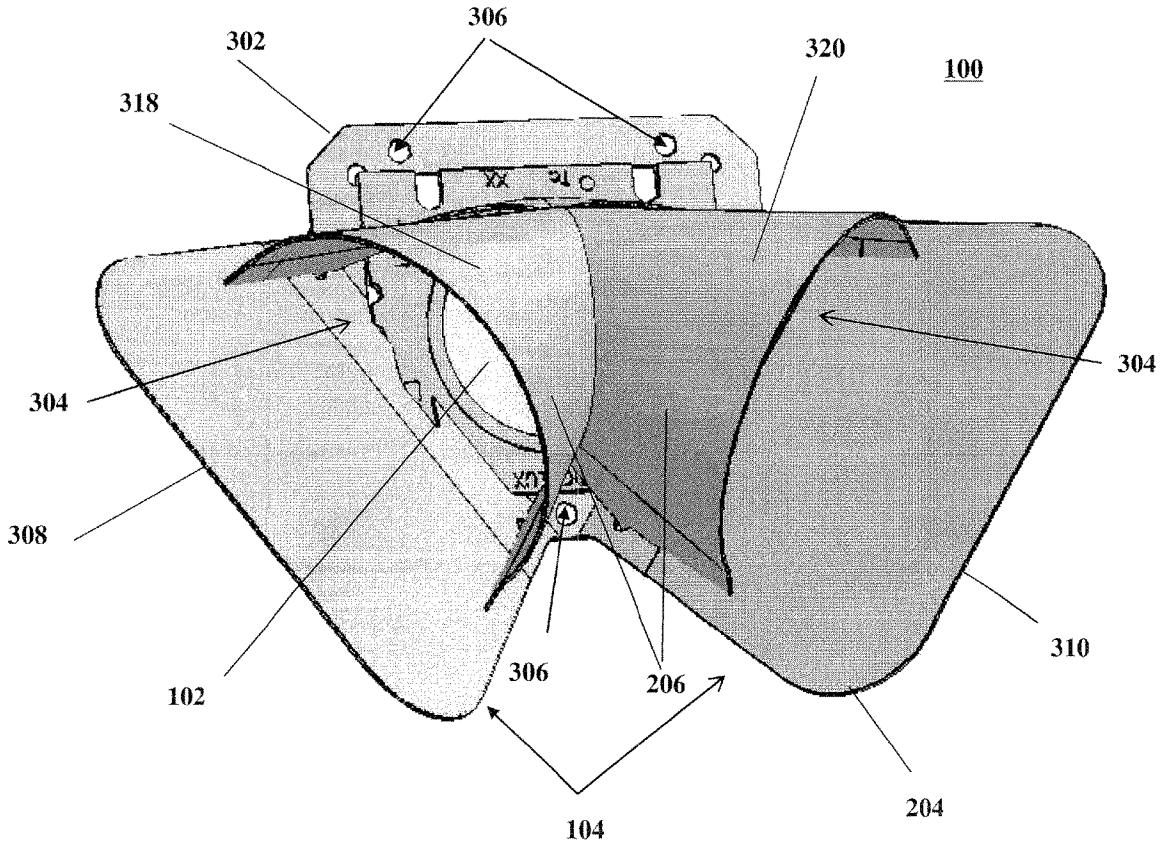
Figure 2A:
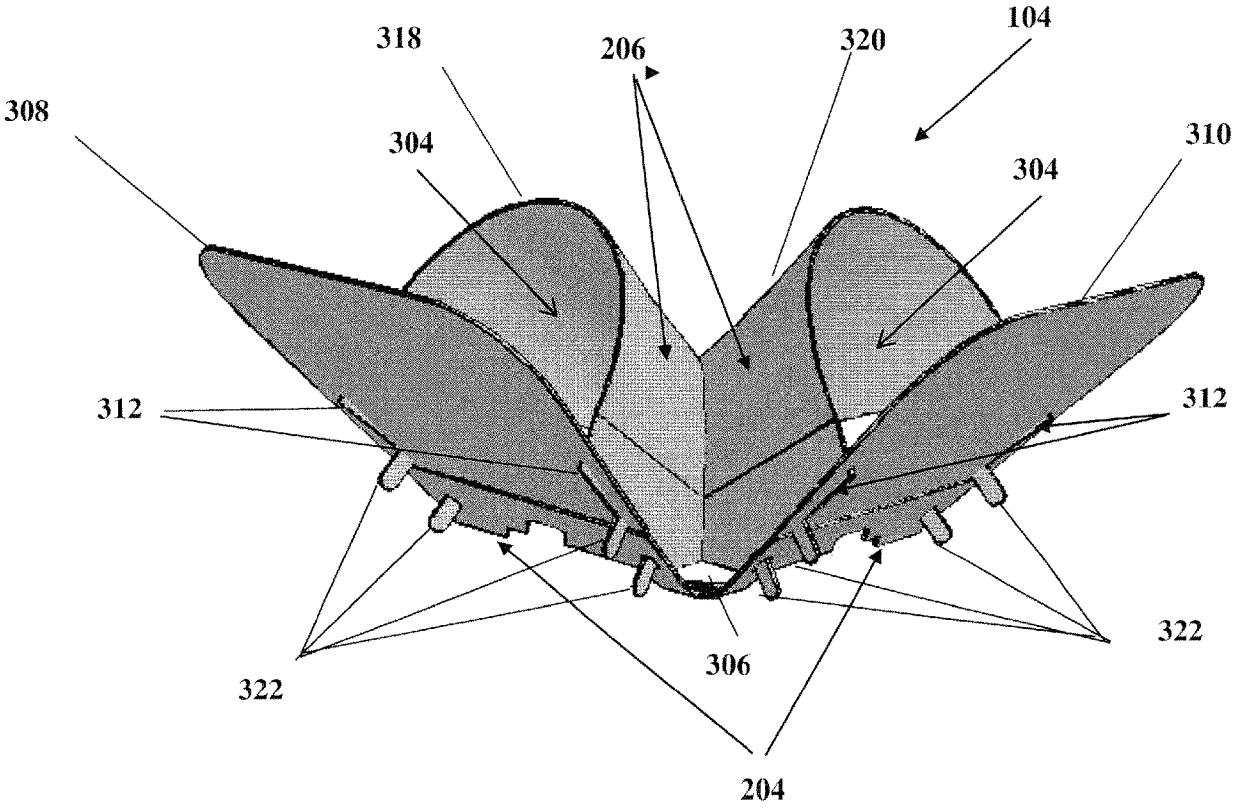
FIGS. 2A-2B are side and front views, respectively, of the double-reflective assembly configured in accordance with one aspect of the light emitting device module disclosed herein.
Figure 2B:
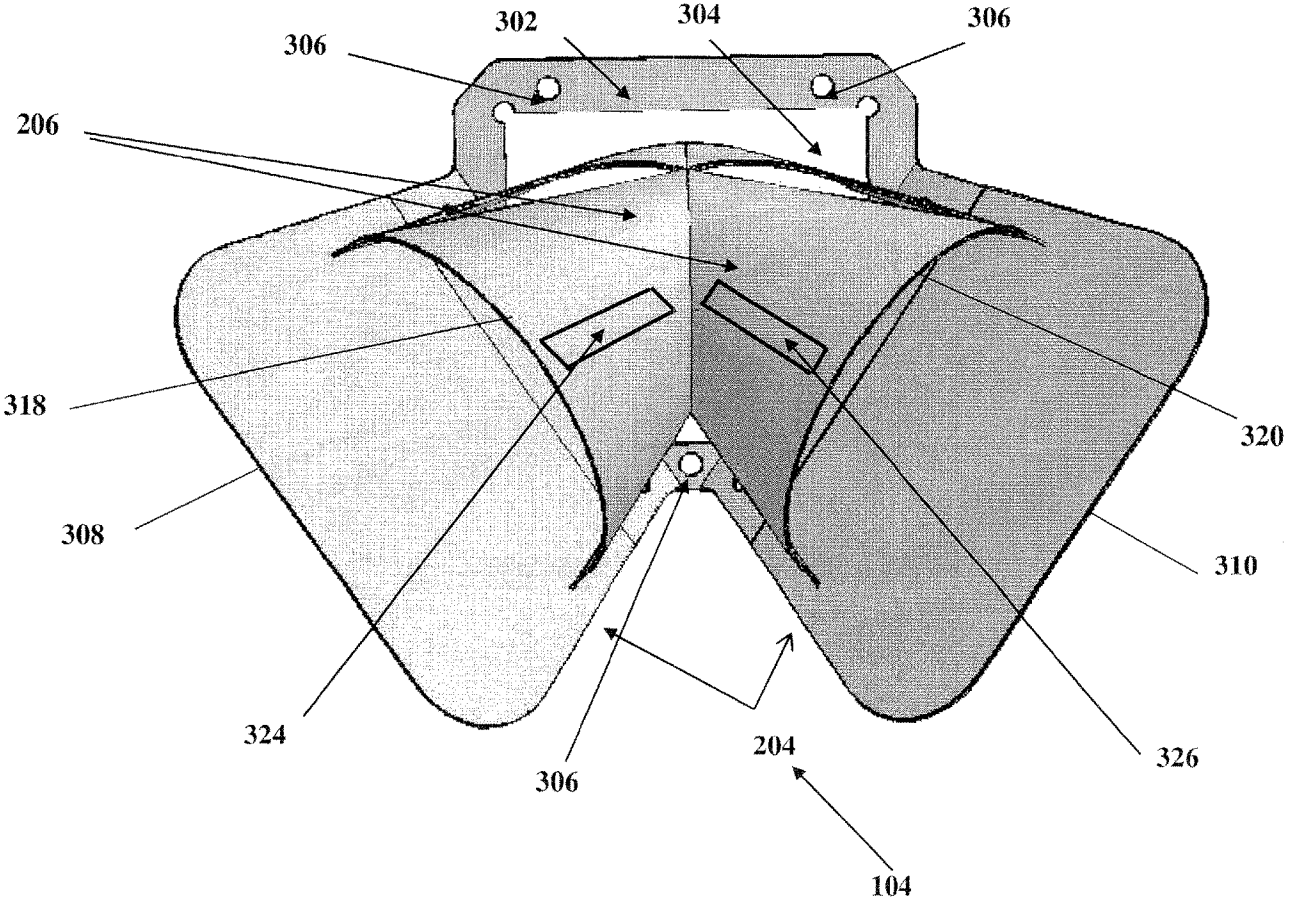
Figure 3:
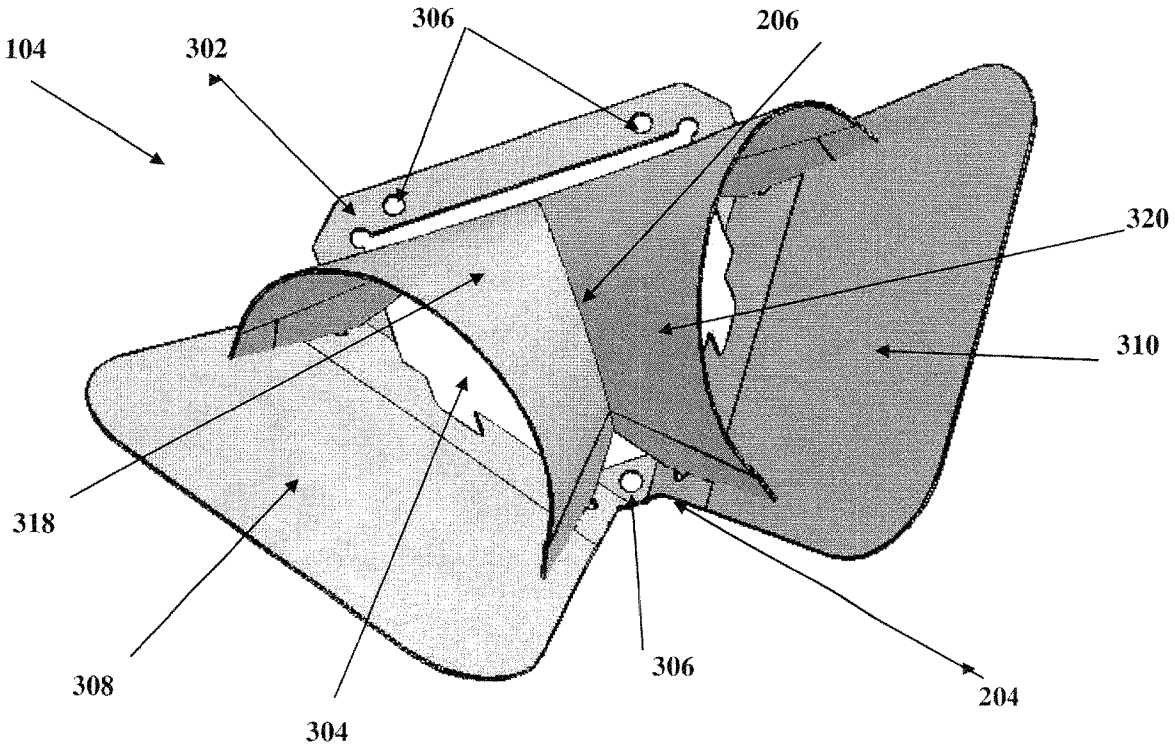
FIG. 3 is a perspective view of the double-reflective assembly configured in accordance with one aspect of the light emitting device module disclosed herein.

FIGS. 1A and 1B are perspective views of an exemplary light array module 100. The light module 100 includes LED array 102 and double-reflective assembly 104. FIGS. 2A and 2B are, respectively, side and front views of double-reflective assembly 104, and FIG. 3 is a perspective view of double-reflective assembly 104. In an aspect of the LED array module set forth herein, slots 202 provide for fasteners such as screws to affix the light emitting device array 102 to a heat sink (not shown).

As shown in FIGS. 1A, 1B, 2A, 2B and 3, double-reflective assembly 104 comprises lower member 204 and upper member 206 attached to each other by way of pins 322 on the upper member 206 and slots 312 on the lower member 204. The interior surfaces of the double-reflective assembly 104 are highly reflective surfaces.

In FIG. 2A, lower member 204 includes a frame 302, an LED array opening 304, holes for affixing to heat sink 306, a left bottom reflector 308, a right bottom reflector 310, and slots 312.

In FIG. 2B, upper member 206 includes a left top reflector 318, a right top reflector 320, and pins 322 (visible in FIG. 2A) corresponding to slots 312.

The lower member 204 of double-reflective assembly 104 includes left bottom reflector 308, right bottom reflector 310 and frame 302 (shown in FIG. 1B) with a light emitting device array opening 304 in which the LED array 102 is located and positioned. Frame 302 has holes 306 for screws to fix double-reflective assembly 103 on a heat sink (not shown).

The upper member 206 of double-reflective assembly 104 comprises a left top reflector 318 and a right top reflector 320. In another aspect, as shown in FIG. 2B, the left top reflector 318 and the right top reflector 320 may have one or more additional openings 324 and 326 respectively, to provide additional control to direct light into the pattern directly from the LED array 102 without first reflecting from any surfaces.

In an aspect of the disclosure, an optical axis of left bottom reflector 308 is coincident with an optical axis of the left top reflector 318, and an optical axis of right bottom reflector 310 is coincident with an optical axis of the right top reflector 320.

Figure 4:
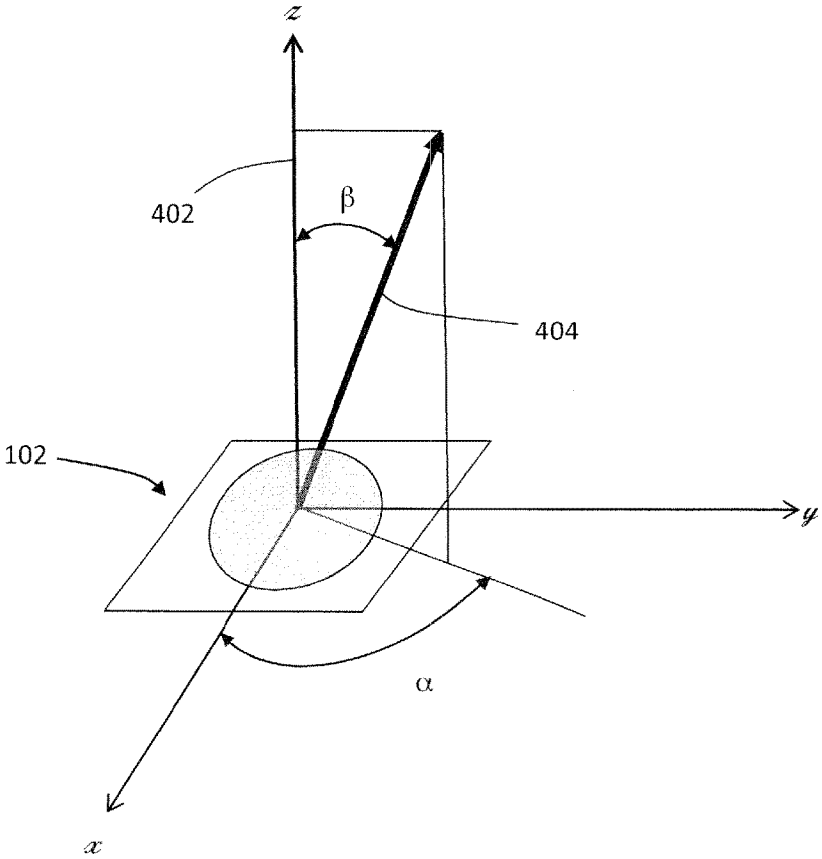
FIG. 4 is a graphic representation of the relationship between orthogonal and polar coordinates in a light emitting device array module domain.

FIG. 4 presents a relationship between orthogonal coordinates (x, y, z) and polar coordinates [P(α, β)] in a light module 100 reference domain. As shown in FIG. 4, the center of coordinates is located in a geometrical center of the LED array 102. The LED array 102 is located in a plane of orthogonal x-y coordinates, and a z axis, orthogonal to the x-y plane, defines a LED array optical axis 402.

Any arbitrary direction 404 in x, y, z coordinates can be presented by polar coordinates α and β, where α is an angle in the x-y coordinate plane relative to axis x and a plane in which direction 404 and axis z are located, and β is an azimuth angle in this plane between the axis z and direction 404.

Both orthogonal and polar coordinates can be mutually transferred using simple equations.

Figure 5A:
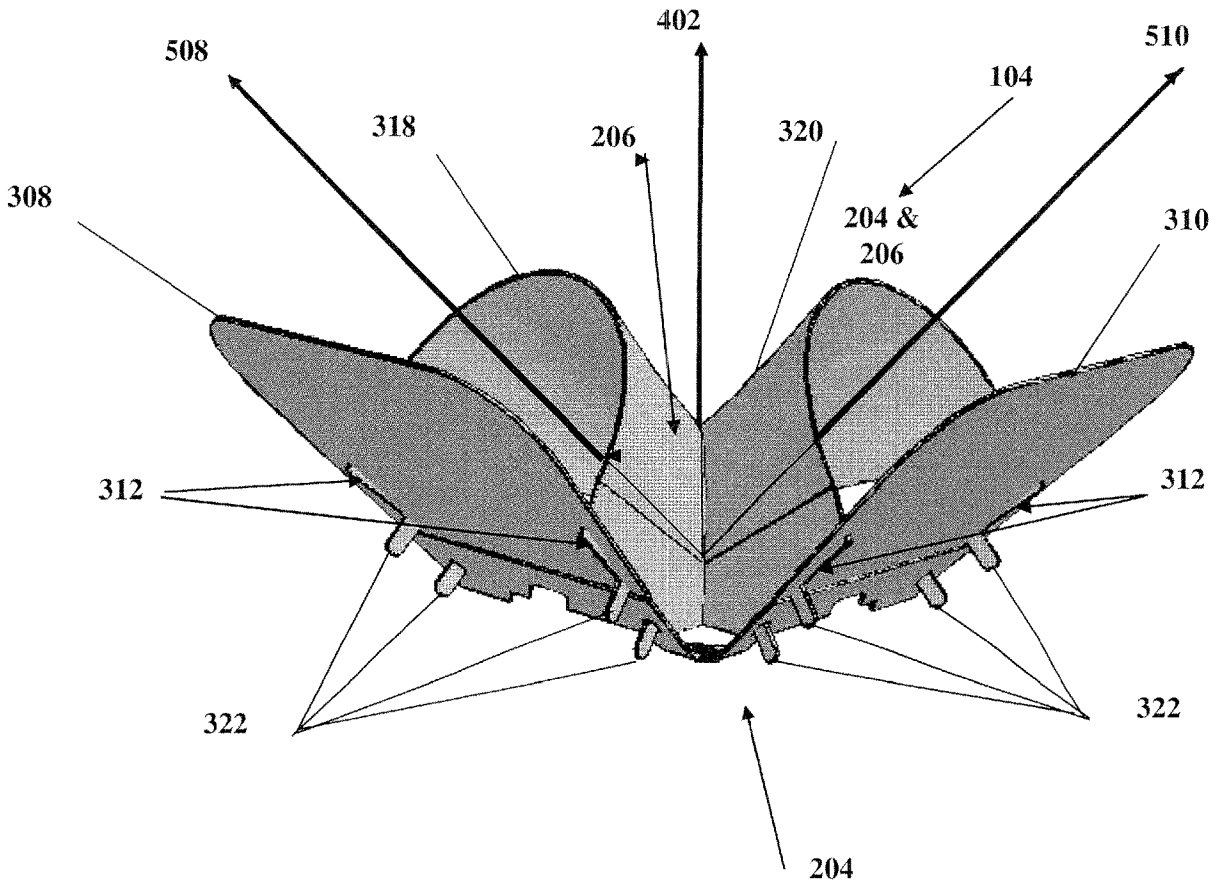
FIGS. 5A-5B are another side and front views, respectively, of the double-reflective assembly that shows spatial orientation of optical axes.
Figure 5B:
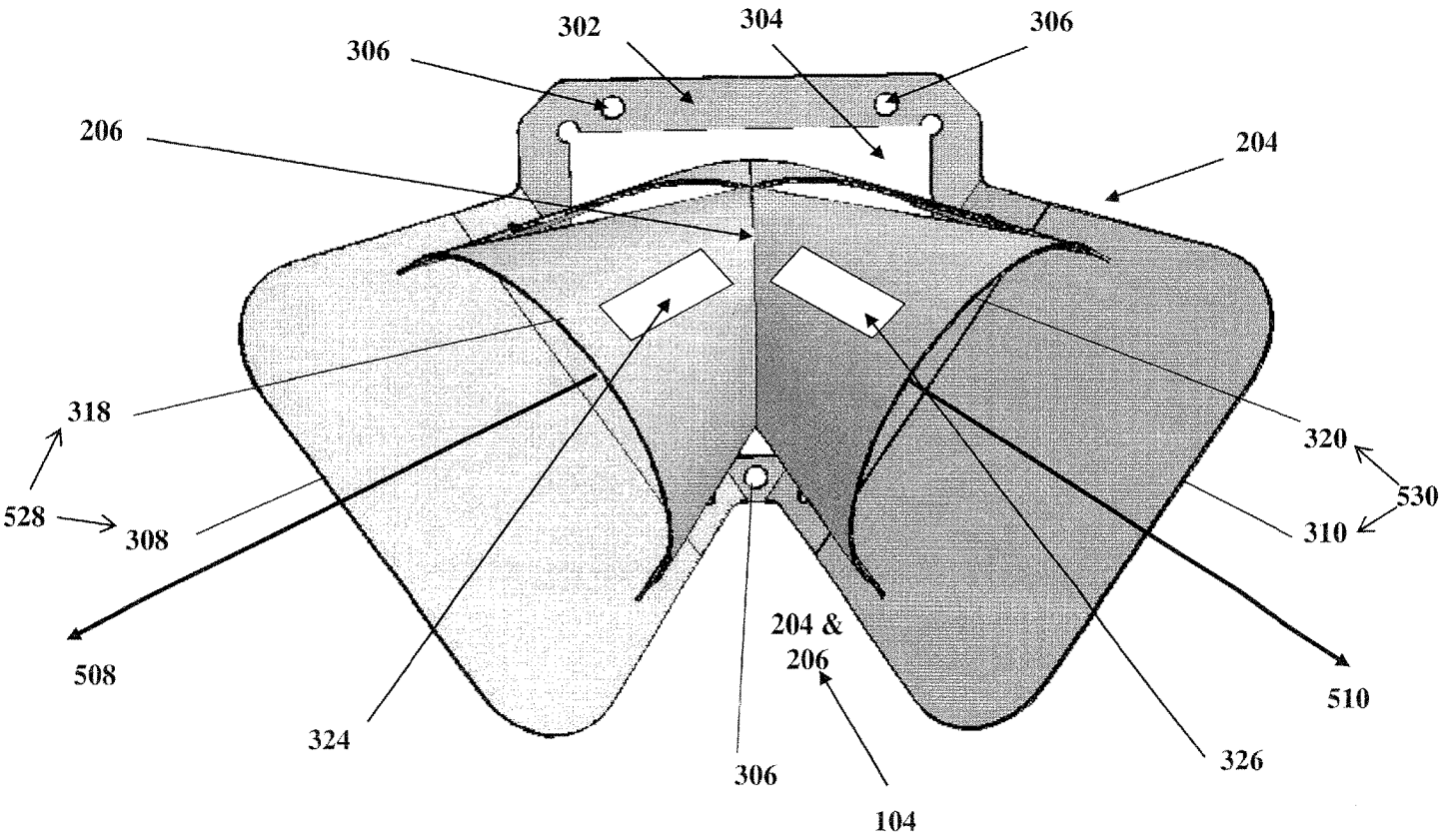

FIGS. 5A and 5B are, respectively, another side and front views showing double-reflective assembly optical axes.

As shown in FIGS. 5A and 5B, assembled left bottom reflector 308 and left top reflector 318 form a left double reflective component 528 of a double reflective assembly 104.

Left double-reflective component 528 has an optical axis 508 with a spatial orientation that can be described as a direction $\rho_l(\alpha_l, \beta_l)$ in polar coordinates.

Accordingly, assembled right bottom reflector 310 and right optic reflector 320 that form right double reflective component 530, have an optical axis 510 with a spatial orientation that can be described as a direction $\rho_r$, $(\alpha_r, \beta_r)$ in polar coordinates.

In general, $\alpha_l \neq \alpha_r$ and $\beta_l \neq \beta_r$ which means that spatial orientation of left double reflective component and right double reflective component are arbitrary to each other. In other words, the spatial orientations and resulting light patterns may be asymmetrical.

In the case where $\alpha_l = \alpha_r$ and $\beta_l = \beta$, axes 508 and 510 have mirror symmetry relative to plane x-z in orthogonal coordinates.

In operation the LED array 102 emits light with a complicated spatial intensity distribution I (α, β).

In general, an LED array spatial intensity distribution can be described using the following functional:

$$I(\alpha, \beta) = F\{n; (x_i, y_i); \Sigma^n I_i; \sigma; \rho\},$$

where:

n is the number of single emitters in array;

$x_i$, $y_i$, are coordinate of single emitter in x-y plane;

$I_i$ is intensity of single emitter;

σ is an area parameter including the active array surface; and

ρ is the function, related to light wavelength transformation (e.g., from blue to white).

The LED array spatial intensity distribution I (α, β) may be represented in a number of ways: as a system of analytical equations, as a graphics, as a ray tracing file, etc.

In a plane to be illuminated, such as a parking lot surface, a required intensity distribution across the planar surface emitted by the light module 100 may also be given as a function of spatial intensity distribution in a pattern domain in the surface plane to be illuminated.

Figure 6:
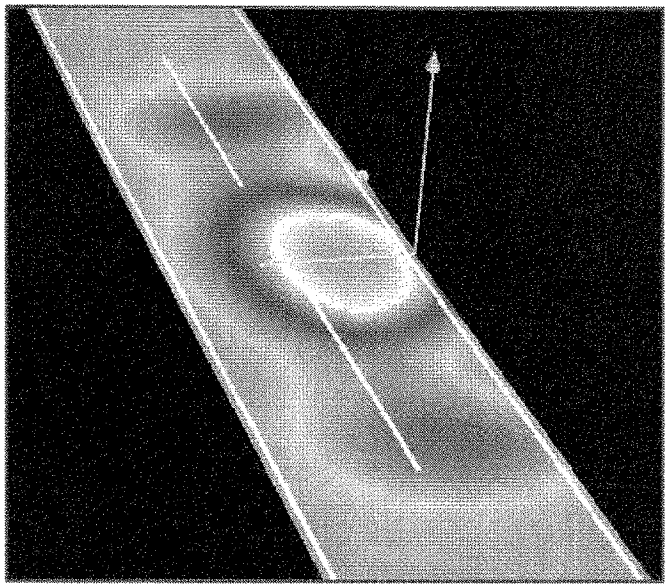
FIG. 6 are charts illustrating a light dispersal pattern with non-circular asymmetrical light distribution.
Figure 6:
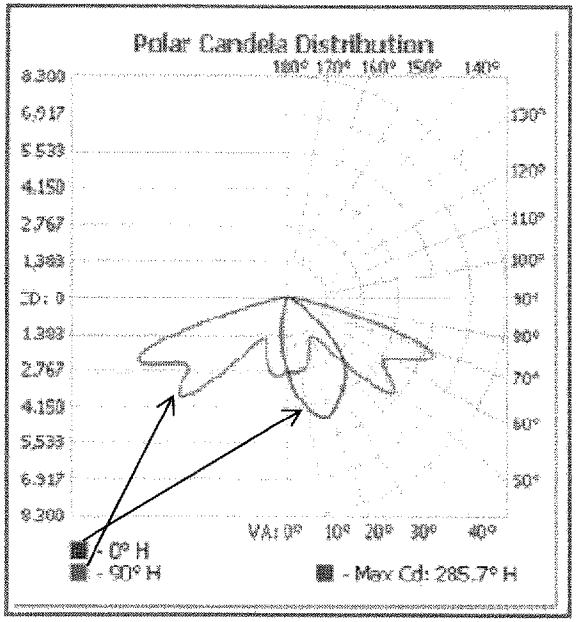

FIG. 6 is an example of a light pattern with non-circular asymmetrical light distribution that may be produced by the light module 100.

One goal is to transform a given LED array spatial intensity distribution I(α, β) with high efficiency into a pre-calculated (given, e.g., pre-determined) intensity distribution across the illuminated planar pattern domain by the use of a double-reflective assembly.

Light distribution across the pattern forms as a superposition of constituents, including light directed into the pattern directly from the light source (LED array 102), light reflected from the bottom reflectors, light reflected from the top reflectors, light double-reflected from both top and bottom reflectors.

FIGS. 7A-7E are cross-sectional views of right double-reflective component 530 in a plane of optical axis 510, located perpendicular to the x-y plane in LED array module domain. For simplicity, the LED array 102 is shown as a point source, just to demonstrate conceptual difference between the constituents, listed above.

Figure 7B:
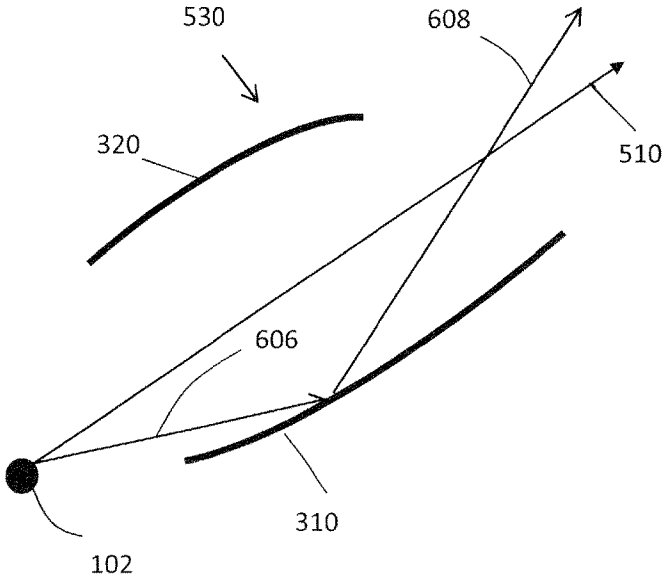
FIGS. 7A-7E are cross-sectional views of a right double-reflective component in a plane containing the optical z axis located perpendicular to x-y plane containing the light emitting device array module domain.
Figure 7A:
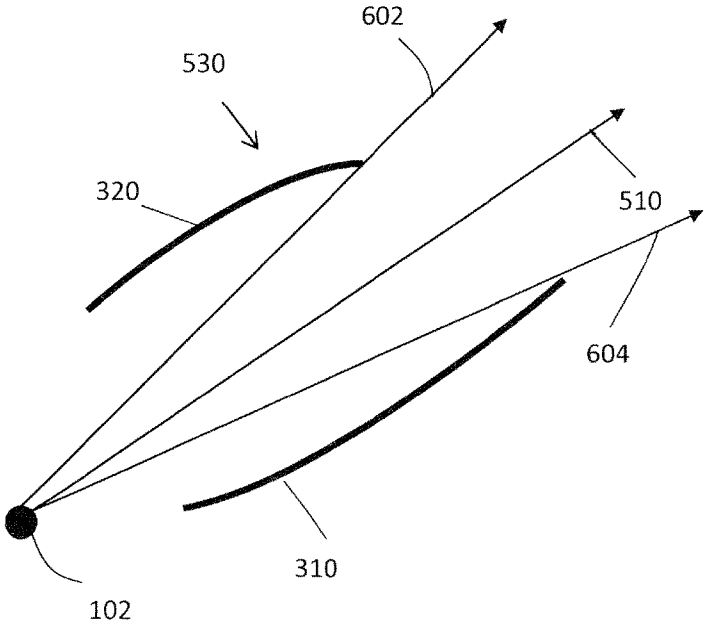

As shown in FIG. 7A, all rays emitted by the LED array 102 and located between ray 602 (passing without reflection from top reflector 320) and ray 604 (passing without reflection from bottom reflector 310) are directed into the pattern in a direction around optical axis 510 directly from the LED array 102.

FIG. 7B is an exemplary view of ray 606 emitted by the LED array 102 and reflected by the right bottom reflector 310 into ray 608 directed into the pattern.

Figure 7D:
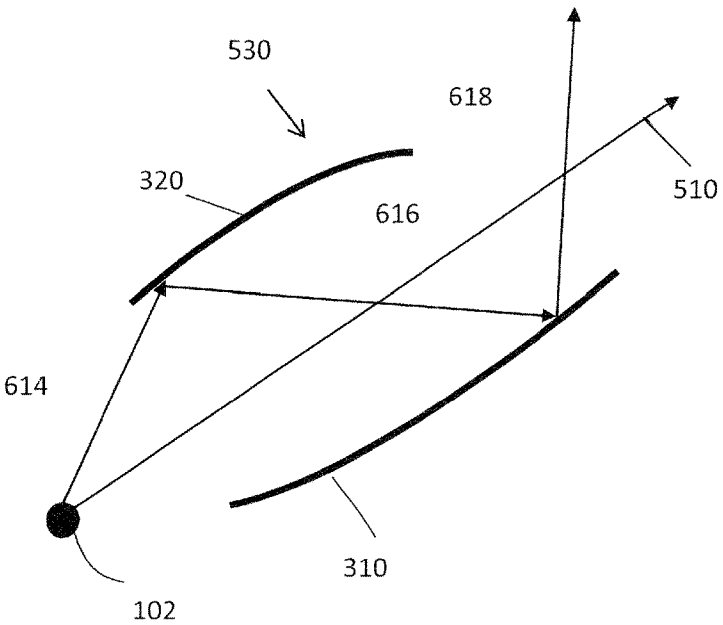
Figure 7C:
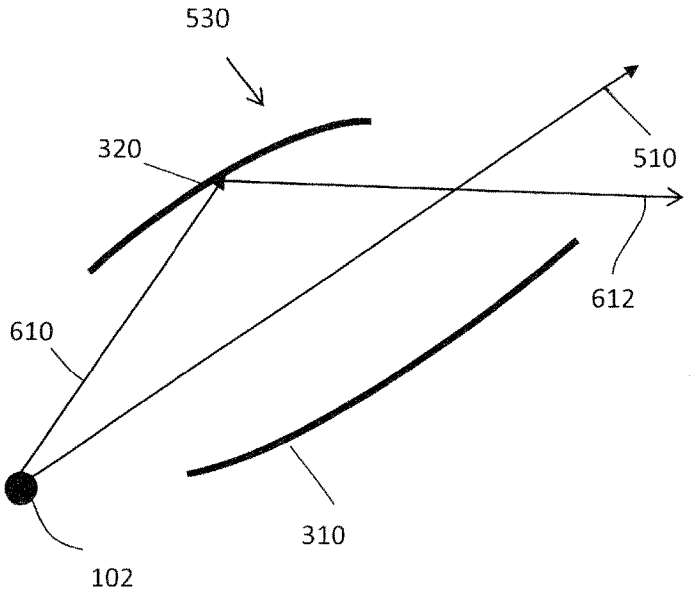

FIG. 7C is an exemplary view of ray 610 emitted by the LED array 102 and reflected by the right top reflector 320 into ray 612 directed into the pattern.

FIG. 7D is an exemplary view of ray 614 emitted by the LED array 102, reflected by the right top reflector 320 as a ray 616, and then reflected by right bottom reflector 310 as a ray 618 into the pattern.

Figure 7E:
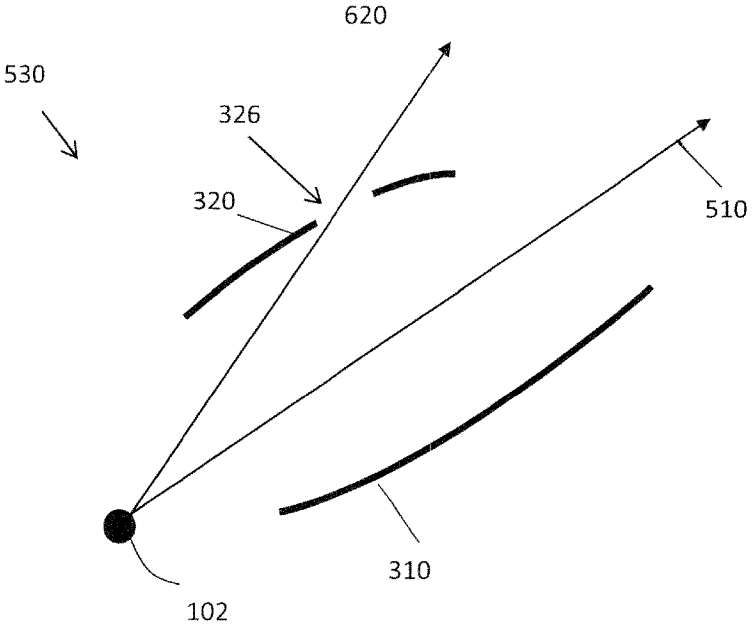

FIG. 7E is an exemplary view of ray 620 emitted by the LED array 102 and emerging through opening 326 into the pattern.

With a given LED array 102 spatial intensity distribution I (α, β) each of the constituents listed above can be calculated as a function of following parameters: the direction of optical axes 508 and 510, the location and orientation of bottom reflectors 308 and 310, and top reflectors 318 and 320, the shape and geometrical dimensions of reflectors 308, 310, 318, 320, and the reflectors 308, 310, 318, 320 profiles.

The superposition of all four constituents creates a final intensity distribution across the plane of the pattern, and can be presented by equation:

$$I_\rho(\alpha, \Theta) = I_d + I_c + I_t + I_{tc}$$

where:

$I_\rho(\alpha, \Theta)$ is the final intensity distribution in the pattern;

α, Θ are polar coordinates in the pattern domain;

$I_d$ is intensity intensity distribution in the pattern directly from LED array 102, including intensity distribution in the pattern from the portion of light emitted by LED array 102 emerging through openings 324 and 326 of top reflectors 318 and 320, respectively;

$I_c$ is intensity distribution in the pattern from the portion of light emitted by LED array 102 and reflected from bottom reflectors 308 and 310;

$I_t$ is intensity intensity distribution in the pattern from the portion of light emitted by LED array 102 and reflected from top reflectors 318 and 320; and $I_{tc}$ is intensity distribution in the pattern from the portion of light emitted by LED array 102, reflected from top reflectors 318 and 320, and double-reflected from bottom reflectors 308 and 310 respectively.

In the case where required intensity distribution in the outgoing pattern is given (predetermined), a procedure such as may be implemented in software may be created to determine the optimal combination of components $I_d$, $I_c$, $I_t$ and $I_{tc}$ by way of calculation of reflectors 308, 310, 318 and 320 profiles, dimensions, geometries, shape, orientation and direction optical axes 508 and 510.

In operation, outgoing light comprises four components: (1) light directed into the pattern immediately from the LED array 102, including the portion of light emitted by LED array 102 emerging through optional openings 324 and 326 of top reflectors 318 and 320 respectively (2) light reflected from the bottom reflector, (3) light reflected from the top reflectors and, (4) light double-reflected from both top and bottom reflectors.

Based on given spatial light distribution of the LED array 102, shapes, geometry and profiles of bottom and top reflectors can be combined to provide a pre-determined required intensity distribution across a non-circular asymmetrical pattern, for example, a street light pattern with required illumination over an asymmetric non-circular area.

The various aspects of this disclosure are provided to enable one of ordinary skill in the art to practice the present invention. The claims are not intended to be limited to the various aspects of this disclosure, but are to be accorded the full scope consistent with the language of the claims. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

What is claimed is:

1. A light module comprising:

a light emitting diode (LED) array having a planar front surface and configured to emit light from the planar front surface; and a double-reflective assembly coupled to the LED array, the double-reflective assembly comprising:

a frame having an opening with the LED array disposed therein and the planar front surface of the LED array being co-planar with the frame;

a lower member comprising:

a left bottom reflector having a planar reflective surface;

a right bottom reflector having a planar reflective surface;

wherein the planar reflective surfaces of the left and right bottom reflectors extend from respective sides of the opening of the frame and at respective angles away from the planar front surface of the LED array, such that the left and right bottom reflectors do not physically intersect the planar front surface of the LED array; and an upper member comprising:

a left top reflector; and a right top reflector, wherein the left top reflector is attached to the left bottom reflector to form a left double-reflective assembly, and the right top reflector is attached to the right bottom reflector to form a right double-reflective assembly, and wherein the left and right double-reflective assemblies each have a shape configured to reflect light emitted from the LED array to distribute respective non-circular intensity light distribution patterns that are asymmetrical with respect to each other.

2. The light module of claim 1, further comprising:

a heat sink coupled to the lower member; and holes in the lower member for fixing the heat sink to the lower member.

3. The light module of claim 1, wherein the intensity light distribution pattern of each of the right and left double-reflective assemblies comprises a superposition of:

an intensity distribution from light directed into the illuminated pattern domain directly from the LED array;

an intensity distribution from light reflected from the bottom reflectors;

an intensity distribution from light reflected from the top reflectors; and an intensity distribution from light double-reflected from both the top and the bottom reflectors.

4. The light module of claim 3, further comprising one or more additional openings in each of the top reflectors.

5. The light module of claim 4, wherein the intensity light distribution pattern of each of the right and left double-reflective assemblies further comprises a further superposition comprising an intensity distribution from light emitted through the one or more additional openings in the top reflectors.

6. The light module of claim 1, wherein the double-reflective assembly is fabricated from sheet metal with a high reflective surface coating.

7. The light module of claim 1, wherein the double-reflective assembly is fabricated from a plastic material by the means of injecting molding and a high reflective coating of reflective surfaces.

8. The light module of claim 7, wherein the double-reflective assembly is fabricated from a high temperature plastic material.

9. The light module of claim 1, wherein the double-reflective assembly is fabricated from a combination of a sheet metal and plastic molded components with high reflective coating.

10. The light module of claim 9, wherein the upper member of the double-reflective assembly comprises two or more molded components.

11. The light module of claim 1, wherein the frame and the LED array are located in an x-y plane with a z axis that is orthogonal to the x-y plane.

12. The light module of claim 11, wherein the shape of the left double-reflective assembly defines an optical axis for the respective non-circular intensity light distribution pattern having an optical axis with a spatial orientation in a direction $\rho_l(\alpha_l, \beta_l)$ in polar coordinates relative to the x-y plane.

13. The light module of claim 12, wherein the shape of the right double-reflective assembly defines an optical axis for the respective non-circular intensity light distribution pattern having an optical axis with a spatial orientation in a direction $\rho_r(\alpha_r, \beta_r)$ in polar coordinates relative to the x-y plane, and wherein $\alpha_l \neq \alpha_r$ and $\beta_l \neq \beta_r$.

14. A method of forming a light distribution pattern in a plane of illumination, comprising:

emitting light from a light emitting diode (LED) array having a planar front surface and configured to emit light from the planar front surface; and reflecting a portion of the emitted light from a double-reflective array assembly, the double-reflective assembly comprising:

a frame having an opening with the LED array disposed therein and the planar front surface of the LED array being co-planar with the frame;

a lower member comprising:

a left bottom reflector having a planar reflective surface;

a right bottom reflector having a planar reflective surface;

wherein the planar reflective surfaces of the left and right bottom reflectors extend from respective sides of the opening of the frame and at respective angles away from the planar front surface of the LED array, such that the left and right bottom reflectors do not physically intersect the planar front surface of the LED array; and an upper member comprising:

a left top reflector; and a right top reflector, wherein the left top reflector is attached to the left bottom reflector to form a left double-reflective assembly, and the right top reflector is attached to the right bottom reflector to form a right double-reflective assembly, and wherein the reflecting of the portion of the emitted light from the double-reflective array assembly comprises reflecting light emitted from the LED array by the left and right double-reflective assemblies each have a shape that distributes respective non-circular intensity light distribution patterns that are asymmetrical with respect to each other.

15. The method of claim 14, further comprising:

coupling a heat sink to the lower member; and providing the lower member with holes for fixing the heat sink to the lower member.

16. The method of claim 14, wherein the intensity light distribution pattern of each of the right and left double-reflective assemblies comprises a superposition of:

an intensity distribution from light directed into the pattern directly from the LED array;

an intensity distribution from light reflected from the bottom reflectors;

an intensity distribution from light reflected from the top reflectors; and an intensity distribution from light double-reflected from both top and bottom reflectors.

17. The method of claim 16, wherein the top reflectors further comprise one or more additional openings.

18. The method of claim 17, wherein the intensity light distribution pattern of each of the right and left double-reflective assemblies further comprises a further superpositioning of an intensity distribution from light emitted through the one or more additional openings in the top reflectors.

* * * * *